US005797419A

United States Patent [19]

Perrott et al.

[11] Patent Number: 5,797,419

[45] Date of Patent: Aug. 25, 1998

[54] SEWER LINE TRAP PRIMING ASSEMBLY AND ANTISIPHONING CONDUIT COMPONENT THEREFOR

[75] Inventors: Charles H. Perrott; Frank W. Dowdican, both of Portland, Oreg.

[73] Assignee: C.H. Perrott, Inc., Portland, Oreg.

[21] Appl. No.: 583,723

[22] Filed: Jan. 5, 1996

[51] Int. Cl.[6] ..... F16K 1/12; E03C 1/296

[52] U.S. Cl. ..... 137/216; 137/247.25; 137/624.11; 137/797; 137/118.05

[58] Field of Search ..... 137/216, 216.1, 137/216.2, 247.25, 624.11, 797, 118.05

[56] References Cited

U.S. PATENT DOCUMENTS

| | | | |
|---|---|---|---|
| 2,056,357 | 10/1936 | Luff | 137/216 |
| 2,655,024 | 10/1953 | Sway | 137/216 X |
| 3,134,392 | 5/1964 | Goss | 137/118.05 |
| 3,158,169 | 11/1964 | Smith | 137/216 |
| 3,381,700 | 5/1968 | Frymark | 137/216 |
| 3,411,524 | 11/1968 | Raine et al. | 137/216 |
| 3,776,269 | 12/1973 | Watts | 137/118.05 X |
| 4,438,861 | 3/1984 | McGuffey | 137/216 X |
| 4,467,830 | 8/1984 | Hutchinson | 137/216 X |
| 4,497,337 | 2/1985 | Mosbrucker et al. | 137/247.25 |
| 5,253,670 | 10/1993 | Perrott | 137/247.25 |

*Primary Examiner*—John Rivell
*Attorney, Agent, or Firm*—Olson & Olson

[57] ABSTRACT

An automatic sewer line trap priming assembly including a gap type, anti-siphoning conduit component. A shielded and directed jet at timed intervals directs priming water increments into a receiving funnel which communicates with the trap.

8 Claims, 1 Drawing Sheet

SEWER LINE TRAP PRIMING ASSEMBLY AND ANTISIPHONING CONDUIT COMPONENT THEREFOR

BACKGROUND OF THE INVENTION

1. Field of the Invention

This invention relates to sewer line trap priming assemblies and to an antisiphoning conduit component for use therein.

2. Description of the Prior Art

Most municipal plumbing and sanitary codes require that means be provided for supplying water automatically and periodically to all sewer line water trap systems. This insures that the trap components of the system will be fully charged and operative at all times.

In view of the complexity of such system, this is a difficult undertaking. In a single apartment house, office building or supermarket there literally may be dozens of sewer line traps associated with lavatories, laundry rooms, refrigerated display cases and the like. The traps must be kept operatively filled with water at all times. To overcome the effect of evaporation, this requires the addition of priming water at periodic intervals.

A further problem associated with the operation of such systems resides in the fact that substantial fluctuations in pressure occur in the associated plumbing conduits when the appliances which they serve are used. When there is a material reduction in pressure the possibility exists of raw sewage being drawn up, or siphoned, from the sewers, through the traps, and into the house lines. There exists the further possibility of pathogenic bacteria introduced in this manner establishing themselves in domestic plumbing systems, thereby spreading infection. As a consequence, many municipal building codes require the association of anti-siphoning devices with sewer line traps.

It is the general purpose of the present invention to provide such a device.

It is a further object of the present invention to provide such a device which is simple in design, easily installed, and efficient in operation.

Still a further object of the invention is the provision of an anti-siphoning timing and valving system for supplying priming water to sewer line traps in controlled amount at stipulated time intervals.

BRIEF STATEMENT OF THE INVENTION

Broadly stated, the foregoing and other objects of the invention are achieved by the provision of a gap-type, anti-siphoning conduit component comprising, in substantially sequential axial alignment an upper coupling segment for coupling to a pressurized upstream supply conduit; a shield segment of enlarged diameter; within the shield segment and substantially coaxial therewith a pipe of reduced diameter; a funnel segment of enlarged diameter positioned for receiving the fluid discharged by the pipe, between the shield and funnel segments a gap segment having therein an opening to the exterior; and a lower coupling segment for coupling to a downstream discharge conduit.

Associated with the anti-siphoning conduit component upstream thereof is a valve for initiating and arresting the flow of water therein, and a valve control operatively associated with the valve for opening and closing it at predetermined time intervals.

If desired, the gap segment may comprise a continuous gap spacing the upstream shield component from the downstream funnel segment. This ensures that the plumbing inspector can pass his hand through the gap and establish to his satisfaction that the priming system is operative and that there is no possibility of bacterial transfer from the sewer line to the house plumbing.

In the alternative, the gap segment may comprise a plurality of removable, radially spaced, connecting bars defined by score lines and separated by anti-siphoning openings 40.

Thus, the timer-controlled valve enables supplying priming water to the sewer line traps on a periodic basis. The anti-siphoning conduit component prevents the siphoning of sewage into the house water system. The continuous gap, if employed, prevents the transfer of bacteria from the sewage into the house plumbing system. The major problems associated with the maintenance of sewer line traps thus are overcome.

THE DRAWINGS

DESCRIPTION OF A PREFERRED EMBODIMENT OF THE INVENTION

Figure 1:
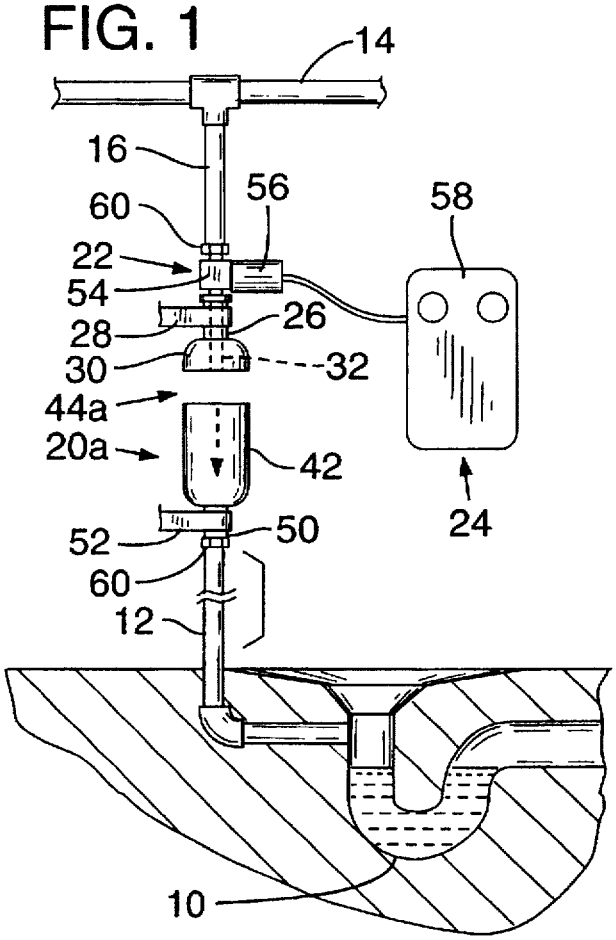
FIG. 1 is a schematic view of a plumbing system including the herein described sewer line trap priming assembly and the anti-siphoning conduit component thereof in one of its embodiments.
Figure 3:
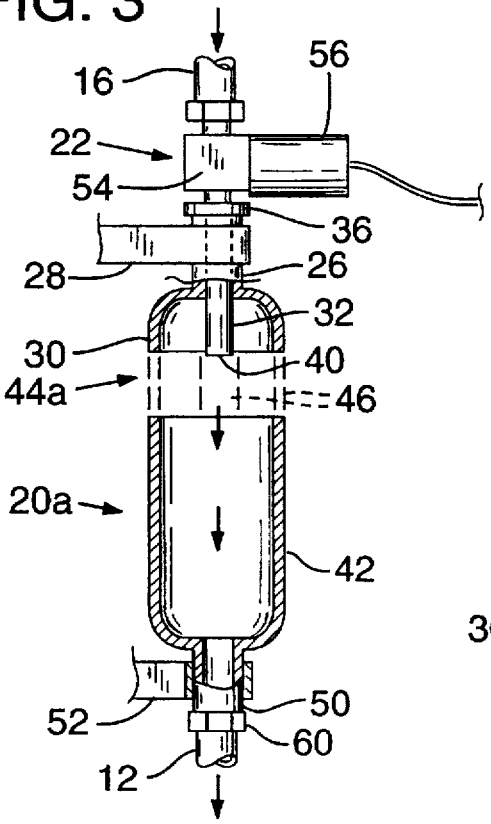
FIG. 3 is a view similar to FIG. 2 but with the conduit component illustrated in longitudinal section.

As shown in FIG. 1, the sewer line trap priming assembly of our invention is designed to serve the conventional sewer line system including a trap 10 and a priming conduit 12. Priming water is supplied from house line 14 by a supply conduit 16.

The assembly comprises an anti-siphoning conduit component, indicated generally at 20 (FIG. 2) or by a modified version 20*a* (FIG. 1); a valve for supplying priming water in measured amount at predetermined time intervals, illustrated generally at 22; and a valve controller indicated generally at 24.

Figure 2:
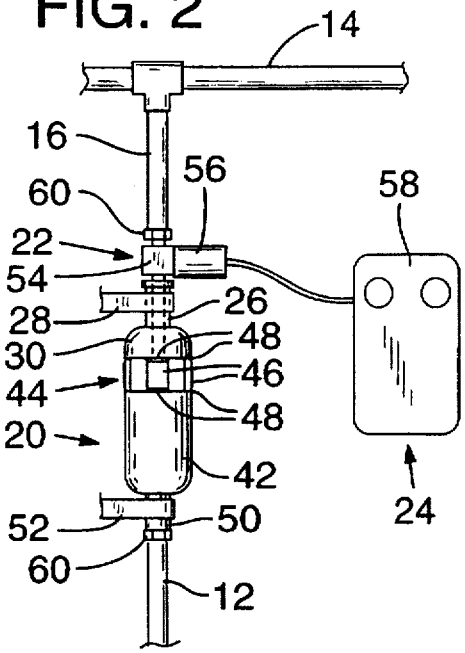
FIG. 2 is a schematic diagram of the system including the conduit component in a second embodiment.

In its integrated embodiment of FIG. 2, conduit component 20 comprises an integral casting of brass or other corrosion resistant metal. It is designed for application in the upright position and comprises the following segments in substantially sequential, axial alignment:

First, an upper mounting segment 26 for connection to an upstream supply conduit containing water under pressure. It serves the ancillary function of providing a structural component by means of which the device can be mounted on an adjacent structural member by means of mounting bracket 28.

Second, a shield segment 30 of enlarged diameter. This serves an anti-splattering function.

Figure 4:
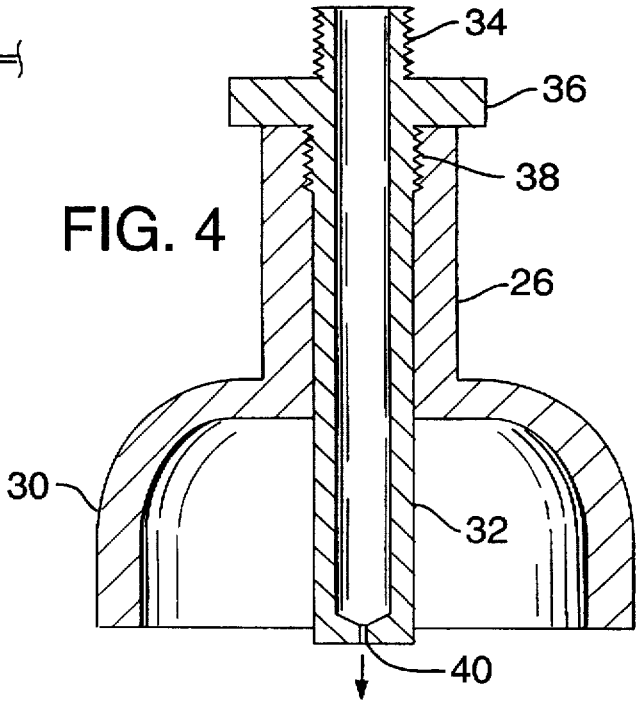
FIG. 4 is an enlarged detail view of a jet orifice-shield subassembly which is a component of the anti-siphoning conduit component.

Third, a pipe or "restricter" 32, FIG. 4. This has an exterior threaded end 34, an external radially extending positioning flange 36 and an interior threaded section 38 by means of which it is mounted in upper mounting segment 26.

The lower terminal portion of pipe 32 has an axial opening 40 of severely restricted cross section which provides a jet stream directed accurately into a receiving funnel segment 42.

Fifth, a funnel segment 42 is of substantially the same diameter as shield segment 30 with which it is aligned and from which it is spaced. It is designed to receive and transmit the jet generated by jet orifice 40.

Sixth, positioned between shield segment 30 and funnel segment 42 is a gap segment 44.

In the embodiment of FIG. 2 this is defined by a plurality of radially spaced connecting bars 46.

The length of the bars is determined by transverse score lines 48. The score lines, in turn, make it possible using a pair of pliers or other implement to tear or wrench the bars in order to separate them from their anchoring structural elements. There thus may be provided the continuous gap 44*a* of FIG. 1.

It is to be noted that connecting bars 46 not only serve to define the anti-siphoning openings; they also serve to integrate the device and maintain the shield and funnel components of the device in their properly aligned position during storage and installation. This ensures that the jet stream will be properly aligned with the funnel during use and will not splatter outside the assembly. Howver, after the device is securely mounted the connecting bars 46 can be forcibly torn away leaving the continuous gap 44*a* of FIG. 1.

As noted, this has a two-fold advantage. First it prevents the transmission of sewage bacteria to the house plumbing system. Second, assuming that the installation is in a location where it is not readily visible, it enables the plumbing inspector to satisfy himself that the required anti-siphoning gap is present and functioning by merely passing his hand through the gap.

Funnel segment 42 communicates at its lower end with lower mounting neck 50. This element of the unit serves as a means for mounting the lower end of the device to a structural member by means of mounting bracket 52. It also serves as a means of coupling the lower end of the device to priming conduit 12.

It is to be noted that, although anti-siphoning conduit component 20 is described herein in association with a sewer line trap installation, it is versatile in use and may be employed in a variety of conduit or piping systems.

Priming water under pressure is supplied to conduit component 20 from pressurized house line 14 in measured amount at predetermined timed intervals by means of a valving system indicated generally at 22.

In the embodiment of FIGS. 1 and 2 the valving system includes a poppet type of valve 54 not illustrated in detail but comprising the usual disc and seat components. This is operated by means of a solenoid 56 with associated timer and control box 58. A subassembly suitable for the purposes of the invention is sold in the year 1995 under the brand name of AFCO "Red Hat" solenoid valve, a product of Automatic Switch Company of Florham Park, N.J. The use of this valving system ensures that exactly the proper amount of priming water will be discharged to the trap at exactly the proper time intervals.

However, other valve types may be employed in place of the poppet valve. One such valve is the valve for charging sewer line water traps described and illustrated in Watts U.S. Pat. No. 3,422,835. This valve is sensitive to and actuated by changes in house water line water pressure, such as occur when a toilet is flushed, or a washing machine charged. When such a change occurs, the valve operates to discharge a small amount of water into the trap.

Whatever its character, the valve is suitably mounted in the supply conduit 16 by means of coupling 60 and the threaded end 34 of pipe 32.

OPERATION

The operation of our sewer line trap priming assembly is as follows:

Upon operation of valve 22 (electrically controlled or pressure drop initiated), a measured amount of priming water is discharged into pipe 32. It passes along the length of the pipe and is discharged via jet orifice 40. The resulting jet spans the anti-siphoning gap, either the restricted gap 44 of FIG. 2 or the continuous gap 44*a* of FIG. 1, and is caught by funnel segment 42. Splattering is prevented by shield segment 30 as well as by the directing effect of pipe 32 and its associated jet orifice 40.

From funnel 42 the priming or make-up charge passes through priming conduit 12 into trap 10 where it makes its contribution toward maintaining the trap at the desired level.

Having thus described in detail a preferred embodiment of the present invention, it will be apparent to those skilled in the art that many physical changes may be made without altering the inventive concepts and principles embodied therein. The present embodiments therefore are to be considered in all respects as illustrative and not restrictive, the scope of the invention being indicated by the appended claims.

We claim:

1. A gap-type anti-siphoning conduit component, comprising:

a) a shield segment of enlarged diameter, b) a pipe of restricted diameter within and secured to the shield segment, c) upper connecting means for connecting said pipe to an upstream supply conduit containing fluid under pressure, d) a funnel segment of enlarged diameter positioned below the shield segment for receiving fluid discharged from said pipe, e) lower connecting means for coupling the funnel segment to a downstream discharge conduit for conveying the fluid to a predetermined processing location, and f) means for supporting the shield and funnel segments in vertically aligned and spaced apart relation for forming an uninterrupted gap therebetween opening to the exterior and isolating the shield and funnel components from each other for preventing bacteria transfer across said uninterrupted gap.

2. The conduit component of claim 1 including a jet-producing tip on the pipe for jetting a stream of fluid across said uninterrupted gap into the funnel segment.

3. The conduit component of claim 1 wherein the support means includes a plurality of radially spaced connecting bars removably connecting the shield segment to the funnel segment temporarily for installation of the conduit component, the bars being removed before operation of the conduit component to prevent bacteria transfer across the uninterrupted gap between the shield and funnel segments.

4. The conduit component of claim 3 including spaced transverse score lines on the connecting bars to enable their forcible separation from the shield and the funnel segments to provide a continuous gap.

5. For use in a conduit conveying priming water in measured amount at predetermined time intervals from a pressurized source to a sewer line trap, a sewer line trap priming assembly comprising in combination, a) valve means in the conduit for initiating and arresting the flow of water therein, b) valve means control means operatively associated with the valve means for opening and closing the same at predetermined time intervals, and c) downstream from the valve means a gap-type, anti-siphoning conduit component comprising, in substantially sequential alignment, 1) an upper mounting segment for connection to an upstream supply conduit containing fluid under pressure, 2) a shield segment of enlarged diameter secured to the mounting segment, 3) within the shield segment a pipe of restricted diameter, 4) a funnel segment of enlarged diameter positioned for receiving fluid discharged by the pipe, 5) means supporting the shield and funnel segments in vertically spaced apart relation for forming a gap therebetween opening to the exterior and isolating the shield and funnel segments from each other, 6) and a lower mounting segment for coupling the funnel segment to a downstream discharge conduit for conveying the fluid to a predetermined processing location.

6. The priming assembly of claim 5 wherein the valve means comprises poppet type valve means.

7. The priming assembly of claim 5 wherein the valve means comprises differential pressure-operated valve means sensitive to pressure drops in the conduit.

8. The priming assembly of claim 5 wherein the control means comprises time-clock-controlled, electric solenoid operated control means.

* * * * *